US007621847B2

(12) United States Patent
Lamle et al.

(10) Patent No.: US 7,621,847 B2
(45) Date of Patent: Nov. 24, 2009

(54) EXERCISE APPARATUS

(76) Inventors: Stewart Lamle, 1032 Second St., Apt # 102, Santa Monica, CA (US) 90403; Tamas Varro, 1528 17 th St., Santa Monica, CA (US) 90404; Barbara Mrena, 1528 17 th St., Santa Monica, CA (US) 90404

( * ) Notice: Subject to any disclaimer, the term of this patent is extended or adjusted under 35 U.S.C. 154(b) by 0 days.

(21) Appl. No.: 11/621,096

(22) Filed: Jan. 8, 2007

(65) Prior Publication Data

US 2007/0161469 A1 Jul. 12, 2007

Related U.S. Application Data

(60) Provisional application No. 60/757,220, filed on Jan. 9, 2006.

(51) Int. Cl.
*A63B 1/00* (2006.01)

(52) U.S. Cl. ..... 482/40; 482/39; 482/93; 482/94; 482/904

(58) Field of Classification Search ..... 482/93, 482/40, 904

See application file for complete search history.

(56) References Cited

U.S. PATENT DOCUMENTS 223,668 A * 1/1880 Duplessis ..... 482/102
963,890 A * 7/1910 Haas ..... 602/32
1,104,505 A * 7/1914 Holworthy ..... 482/24
2,855,200 A * 10/1958 Blickman ..... 482/130
3,115,339 A * 12/1963 Forte ..... 482/139
3,118,441 A * 1/1964 George ..... 601/23
3,218,068 A * 11/1965 Warman ..... 482/40
3,226,115 A * 12/1965 Underhill ..... 482/62
3,614,097 A * 10/1971 Blickman ..... 482/72
4,018,437 A * 4/1977 LoPresti ..... 482/40
4,109,907 A * 8/1978 Zito ..... 482/94

(Continued)

FOREIGN PATENT DOCUMENTS

DE 8623015.8 10/1986

(Continued)

OTHER PUBLICATIONS

US/RO/SO international search report for PCT /US07/60287 completed Jan. 4, 2008 mailed Apr. 14, 2008.

*Primary Examiner*—Loan H Thanh
*Assistant Examiner*—Robert F Long
(74) *Attorney, Agent, or Firm*—Robert W. J. Usher

(57) ABSTRACT

A doorway mounted body exercise apparatus has upper and lower horizontal bars bridging the doorway and carrying respective pulleys and, a rearwardly protruding weight set supporting arm which can be swung between either lateral side to the rear of the doorway to accommodate left and right hand hinged doors and can be retracted into the doorway to permit the door to be completely closed while still mounted. Different cabling arrangements enable the weight set to be used as a counter weight for body weight assistance or additional resistance. An upper frame carrying the upper bar is collapsible for removal and storage or to enable a person to walk through the doorway. The lower bar is hinged at one end to the jamb for swinging up against the jamb so as not to obstruct the doorway when not in use. Footpads on the upper frame enable exercising while hanging upside down.

20 Claims, 16 Drawing Sheets

U.S. PATENT DOCUMENTS

| | | | | | |
|---|---|---|---|---|---|
| 4,111,414 | A | * | 9/1978 | Roberts | 482/39 |
| 4,243,219 | A | * | 1/1981 | Price | 482/103 |
| 4,349,192 | A | | 9/1982 | Lambert | |
| 4,405,127 | A | * | 9/1983 | Miller | 482/40 |
| 4,458,894 | A | * | 7/1984 | Dudley | 482/40 |
| 4,473,225 | A | * | 9/1984 | Miller | 482/40 |
| 4,522,391 | A | | 6/1985 | Rundall | |
| 4,529,191 | A | * | 7/1985 | Miller et al. | 482/40 |
| 4,619,453 | A | * | 10/1986 | Plumridge | 482/102 |
| 4,657,242 | A | * | 4/1987 | Guridi | 482/40 |
| 4,662,629 | A | * | 5/1987 | Plovie | 482/40 |
| 4,666,154 | A | * | 5/1987 | Lipscomb et al. | 482/142 |
| 4,690,133 | A | * | 9/1987 | George | 601/35 |
| 4,747,594 | A | * | 5/1988 | Houde | 482/72 |
| 4,772,011 | A | * | 9/1988 | Guridi | 482/40 |
| 4,844,448 | A | | 7/1989 | Niznik | |
| 4,861,020 | A | | 8/1989 | Soligny | |
| 4,896,881 | A | * | 1/1990 | Djerdjerian | 482/148 |
| 4,974,836 | A | * | 12/1990 | Hirsch | 482/40 |
| 5,011,139 | A | * | 4/1991 | Towley, III | 482/38 |
| 5,046,722 | A | * | 9/1991 | Antoon | 482/39 |
| 5,048,825 | A | * | 9/1991 | Kelly | 482/94 |
| 5,050,869 | A | * | 9/1991 | Frate | 482/94 |
| 5,072,934 | A | * | 12/1991 | Blanes | 482/94 |
| 5,180,350 | A | * | 1/1993 | Thomas | 482/40 |
| 5,186,696 | A | * | 2/1993 | Pfefferle et al. | 482/40 |
| 5,221,240 | A | * | 6/1993 | Mann et al. | 482/40 |
| 5,304,108 | A | | 4/1994 | Denega et al. | |
| 5,322,489 | A | | 6/1994 | Webb et al. | |
| 5,417,628 | A | * | 5/1995 | Vanderbleek | 482/40 |
| 5,423,730 | A | * | 6/1995 | Hirsch | 482/92 |
| 5,569,123 | A | * | 10/1996 | Creatchman | 482/39 |
| 5,601,518 | A | * | 2/1997 | Weintraub | 482/129 |
| 5,626,541 | A | * | 5/1997 | Ramlogan et al. | 482/72 |
| 5,653,666 | A | | 8/1997 | Pantoleon | |
| 5,738,616 | A | * | 4/1998 | Robertson | 482/102 |
| 5,752,903 | A | | 5/1998 | Chang | |
| 5,776,033 | A | | 7/1998 | Brown | |
| 5,820,529 | A | * | 10/1998 | Weintraub | 482/92 |
| 5,871,422 | A | | 2/1999 | Elbogen | |
| 5,941,802 | A | * | 8/1999 | Kiser | 482/92 |
| 5,961,430 | A | * | 10/1999 | Zuckerman et al. | 482/142 |
| 6,017,293 | A | * | 1/2000 | Pfefferle | 482/40 |
| 6,179,748 | B1 | * | 1/2001 | Barr | 482/40 |
| 6,267,711 | B1 | * | 7/2001 | Hinds | 482/121 |
| 6,319,179 | B1 | * | 11/2001 | Hinds | 482/121 |
| 6,398,673 | B1 | * | 6/2002 | Maruca | 473/481 |
| 6,494,817 | B2 | * | 12/2002 | Lake | 482/93 |
| 6,508,743 | B1 | * | 1/2003 | Fortin | 482/41 |
| 6,514,182 | B1 | * | 2/2003 | Chhloeum | 482/130 |
| 6,652,419 | B1 | * | 11/2003 | Rota | 482/27 |
| 6,705,974 | B1 | | 3/2004 | Tardif | |
| 7,014,599 | B2 | * | 3/2006 | Ashley | 482/110 |
| 7,029,423 | B2 | * | 4/2006 | Lear, Jr. | 482/46 |
| 7,066,866 | B1 | * | 6/2006 | Mobley | 482/40 |
| 7,322,909 | B1 | * | 1/2008 | Loccarini et al. | 482/129 |
| 2002/0119869 | A1 | * | 8/2002 | Whited Lake | 482/93 |
| 2003/0220174 | A1 | * | 11/2003 | Lear, Jr. | 482/93 |
| 2003/0232707 | A1 | | 12/2003 | Dalebout | |
| 2005/0227827 | A1 | * | 10/2005 | Liester | 482/93 |
| 2005/0250619 | A1 | * | 11/2005 | Daikeler et al. | 482/40 |

FOREIGN PATENT DOCUMENTS

| | | | |
|---|---|---|---|
| DE | 8523277.7 | | 4/1990 |
| EP | 0258802 | | 3/1988 |
| FR | 2579107 | A1 * | 9/1986 |

* cited by examiner

EXERCISE APPARATUS

RELATED APPLICATION

Priority is claimed from provisional application 60/757220 filed Jan. 9, 2006, the disclosure thereof is incorporated herein by reference.

FIELD OF THE INVENTION

The invention relates to doorway mounted body exercise apparatus for enabling a wide variety of different body exercises to be performed.

BACKGROUND OF THE INVENTION

There have been numerous prior proposals over many years for mounting body exercise apparatus in doorways. However the variety of exercises permitted by any prior individual doorway mounted apparatus has been rather limited.

For example, U.S. Pat. No. 4,458,894 issued 1984 to Dudley teaches a body exercise apparatus comprising: a frame comprising a first, overhead, horizontal support bar having respective opposite ends attached to the door jams so as to bridge the doorway; a second, horizontal, pull bar attached by at least one transverse bar to the support bar to extend in parallel spaced apart relation in front thereof; a pair of depending stabilizing bars having respective upper ends attached to the support bar adjacent opposite ends thereof and a pair of depending strut bars attached at upper ends to the pull bar adjacent respective opposite ends thereof, and at respective lower ends to respective adjacent lower ends of the stabilizing bars, an outwardly extending bar portion provided on each lower end of one of the stabilizing bar and strut bar to protrude in front of respective door jambs so as to be brought into stabilizing pressure engagement therewith by a person's weight applied to the pull bar.

A disadvantage of the prior art is that only a relatively limited number of exercises can be performed without requiring additional devices. For example, there is not provision for a resistance set such as a weight set or elastic resistance cord, for provide resistance or assistance to body weight during body raising or other exercises. The area behind the door is not utilized; the frame is not collapsible for storage and there are not foot supports to enable a person to exercise when hanging upside down—requiring the inconvenience of a person to first donning leg hooks. The possibilities of performing both eccentric and concentric exercises are correspondingly limited.

Although U.S. Pat. No. 4,111,414 issued 1978 to Roberts teaches an exercise apparatus providing a weight set for weight assistance, the reference does not disclose or suggest either doorway mounting or the possibility of adjustment of the apparatus so that the weight set can also provide additional resistance to body weight.

SUMMARY OF THE INVENTION

An object of the invention is to provide doorway mounted exercise apparatus which enables a wide variety of concentric and eccentric exercises to be performed.

An additional object of the invention is to provided a doorway mounted exercise apparatus comprising a frame which, when in operating position, occupies and utilizes the space both within, immediately in front of and behind the doorway, but which can be folded into a wholly or partly collapsed inoperative position, both to leave the space rearward of the doorway free to enable a rearwardly opening door to be completely closed and the doorway itself sufficiently free for a person to walk therethrough substantially unimpeded.

A further object of the invention is to provide such apparatus having means for supporting a resistance set, (for example, a weight set, elastic cord or other device providing resistance to body movement), on either of a selected lateral side of the doorway to accommodate both left hand and right hand rearwardly opening doors.

Another object of the invention is to provide such apparatus in which the user's body weight and force from means supporting the resistance set act on opposite, front and rear, sides of the doorjamb simultaneously, reducing the resultant stress on the door jamb.

An additional object of the invention is to provide such doorway mounted apparatus which can be readily adjusted to provide, selectively, body weight assistance and body weight assistance from the weight set, for example, when performing pullups.

Another object of the invention is to facilitate a person to exercise while hanging upside down without the requirement for leg hooks.

According to one aspect, the invention provides a doorway mounted body exercise apparatus for providing, selectively, assistance and resistance to a person exercising comprising;

means for attaching a cable to an attachment point of a person's body;

at least one upper horizontal support bar attached at respective opposite ends to respective door jambs so as to bridge the doorway;

a lower horizontal support bar attached at respective opposite ends to respective door jambs so as to bridge the doorway;

a resistance set;

pulley means mounted on one of said at least one upper horizontal support bars and pulley means mounted on said lower horizontal support bar; so that a cable attached at one end to the resistance set and at an opposite end to the body attachment point can selectively be passed over one of the upper pulley means and over the lower pulley means to extend upwardly from the body attachment point and downwardly from the body attachment point, respectively, to provide an upward assisting force and a downward resisting force, respectively, for a person performing a body lifting exercise.

It will be appreciated that the resistance set may comprise one or more weights, elastic cord or other devices providing resistance to movement Thus, the invention provides an extremely simply constructed and compact apparatus utilizing the strength of a conventional door frame to support both the exerciser's body weight and the force or weight of the resistance set.

Preferably, the lower horizontal bar is hingedly attached at one end to the jamb and releasably attached at the opposite end to the jamb so that it can be swung upwards out of the doorway to extend vertically adjacent the jamb leaving the doorway free for access therethrough.

According to another aspect, the invention provides a body exercise apparatus for mounting in a doorway comprising:

a frame comprising a first, overhead, level/horizontal support bar having respective opposite ends attached to the door jams so as to bridge the doorway; a second, horizontal, pull bar attached by at least one transverse/perpendicular bar to the support bar to extend in parallel spaced apart relation in front of the support bar and in front of the doorway; a pair of depending stabilizing bars having respective upper ends attached to the support bar adjacent opposite ends thereof and, a pair of depending strut bars attached at upper ends to the pull bar adjacent respective opposite ends thereof and at respective lower ends to respective adjacent lower ends of the stabilizing bars; an outwardly extending portion provided on each lower end of one of the stabilizing bar and strut bar to protrude in front of respective door jambs so as to be brought into stabilizing pressure engagement therewith by a person's weight applied to the pull bar;

wherein foot rests are attached to the frame at spaced apart locations between the support bar and the pull bar and are each shaped to supportively engage an inverted heel and an inverted instep so that a person exercising can hang upside down therefrom by their feet.

The prior requirement for donning leg hooks is thereby obviated.

In one embodiment, the foot rests form laterally open horizontal loops and are attached to supporting laterally opening loops formed in respective transverse bars, respective loop openings providing ankle entry apertures.

In another embodiment, the foot rests each comprise a discrete heel engaging portion and a discrete instep engaging portion which portions are supported by the frame in adjacent spaced apart relation from each other, preferably, by the support bar and by the pull bar. A person can easily insert his ankle between the two portions.

It is further preferred that the instep engaging portion is pivotally mounted for limited swivelling movement and that screw means are provided to vary the separation of the heel supporting portion and the instep supporting to adjust to feet of different sizes.

The frame may further comprise means for operatively supporting a resistance set, comprising a resistance set supporting bar which, in an operating position, protrudes rearwards, cantilever fashion, out of the doorway and has a resistance set cable pulley mounted on a distal, rear end.

The location of the resistance set supporting bar and the pull bar on opposite sides (front and rear) of the doorway assists in providing a more even distribution of force on the door jambs during many exercises in which the exerciser's weight is wholly or partly supported by the pull bar.

In addition, maximum utilization is made of available space, particularly as the area in immediately in front of and behind doorways is normally kept free from obstruction.

Preferably, the resistance set supporting means is adjustable to support the resistance set on either selected lateral side of the doorway thereby to accommodate both left hand and right hand, rearwardly opening doors.

It is further preferred that means are provided on the frame for pivotally mounting the resistance set supporting bar for horizontal swinging movement between either lateral side of the doorway, as selected, for the accommodation of both left hand and right hand opening doors.

Preferably the resistance set supporting bar can be withdrawn forwards into the doorway to free the space behind the door so that a rearwardly opening door can be completely closed when the resistance set is not operative Preferably, means are provided for pivotally mounting the resistance set supporting bar on horizontal support bar so as to extend side by side therewith in the withdrawn position.

It is further preferred that, the means for pivotally mounting the resistance set supporting bar comprises a sleeve pivotally mounted on the support bar and slidingly receiving the resistance set supporting bar for axial movement thereof in the sleeve between extended and withdrawn positions.

In one arrangement, at least a first pair pulleys is mounted for rotation in a horizontal plane on the horizontal support bar, aligned under the proximal end of the resistance set supporting bar when extended in operating position; pulleys of a second pair of pulleys are mounted for rotation in respective vertical planes and for pivotal movement in a horizontal plane in spaced apart relation on the horizontal support bar at medial locations between respective pulleys of the second pair and respective opposite ends of the support bar; respective pulleys of a third pair of pulleys are mounted for rotation in vertical planes at respective opposite ends of the pull bar and a pulley is mounted for rotation in a vertical plane in downwardly open loop bent in the center of the pull bar, whereby a cable extending upward from the weight set, over the pulley on the distal rear end of the resistance set supporting bar can selectively be passed over either pulley of the first pair and an adjacent pulley of the second pair to an adjacent pulley of the third pair or between both pulleys of the first pair over the pulley on the center of the pull bar to enable the performance of different body exercises.

To provide further exercise opportunities, in particular to perform dips, the apparatus includes dip bars having respective upper ends releasably attached to respective portions of respective stabilizing bars adjacent respective lower ends so as to depend therefrom within the doorway adjacent respective door jambs, said dip bars having lower ends formed with respective loops having handrest forming portions that curl inwardly, forwards and then outwards, protruding out of a front of the doorway, shaft portions extending laterally outwardly from free ends of the respective loops to protrude in front of respective door jambs so as to be pivotally biased into stabilizing pressure engagement with a front of each jamb by weight applied to the hand rests by a person performing dips, Suitably, respective upper ends of the dip bars are formed with hooks which embrace respective waisted portions of the stabilizing bars adjacent their lower ends to releasably attach respective dip bars to respective stabilizing bars.

In a collapsible version, the upper ends of respective stabilizing bars are pivotally attached to the level support bar for swinging movement about the support bar in respective vertical planes; the strut bars are attached releasably to the pull bar at respective upper ends and pivotally attached at respective lower ends to the corresponding lower ends of respective stabilizing bars for swinging movement transversely thereof, so that the apparatus can be collapsed to a compact state by releasing the upper ends of the strut bars from the pull bar, swinging the support bars forwards and upwards to extend horizontally with said lower ends adjacent the pull bar and swinging strut bars towards each other to extend horizontally in side by side relation with each other and with the support bar.

Preferably, respective opposite ends of the horizontal support bar are attached releasably to the respective door jambs to permit complete removal from the doorway for compact storage when not in use.

In the collapsed state, the exercise apparatus is of sufficiently low height to be stored under furniture, for example, by pushing under a bed or low table, if demounted from the doorway. Alternatively, if left mounted in the doorway, the collapsed stabilizing bars and struts can be tied to the pull bar increasing the headroom so that a person may walk freely through the doorway.

Preferably said at least one transverse bar is cruciform shape and curved upwards to from a dome structure improving strength and headroom for an exerciser.

BRIEF INTRODUCTION TO THE DRAWINGS

In order that the invention may be readily understood, specific embodiments thereof will now be described by way of example only and with reference to the accompanying drawings in which.

Figure 14A:
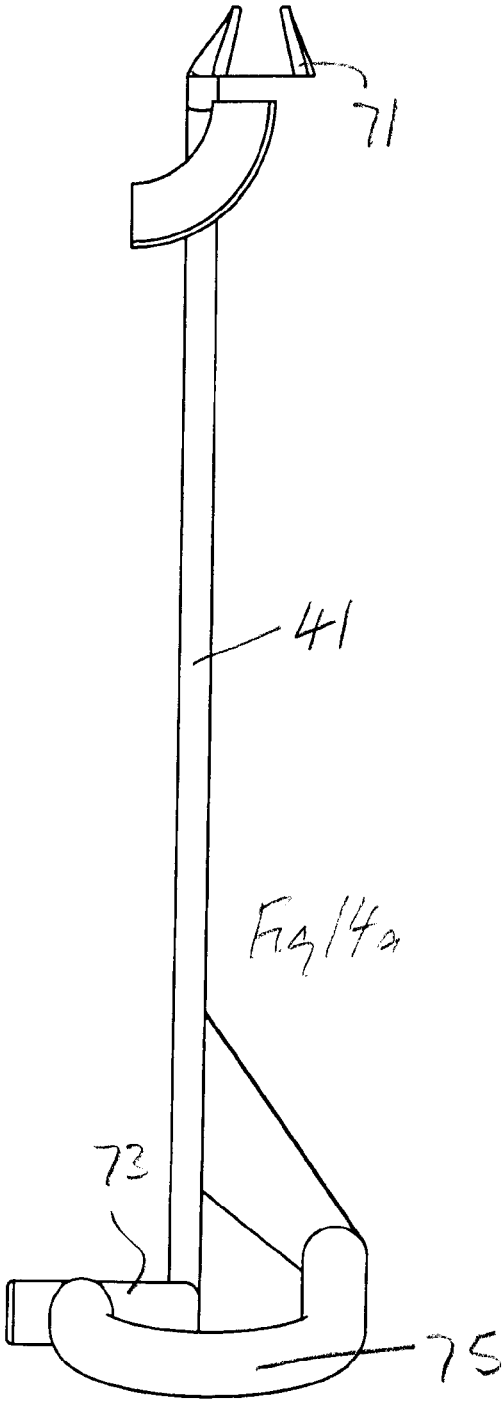
Figure 14B:
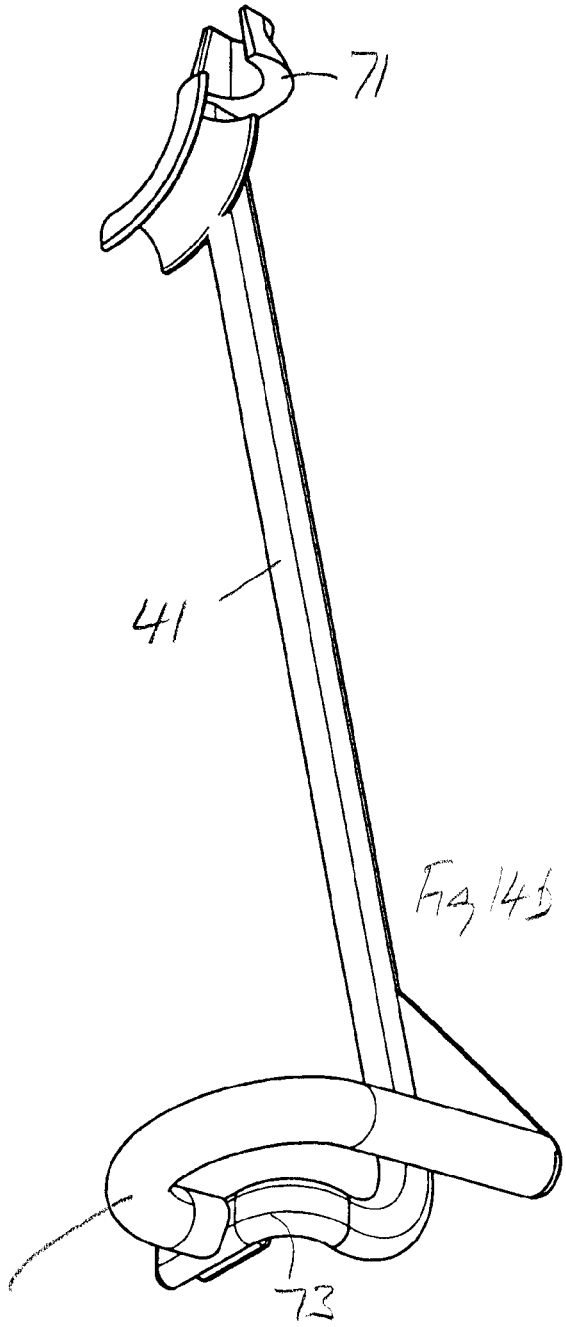
Figure 15:
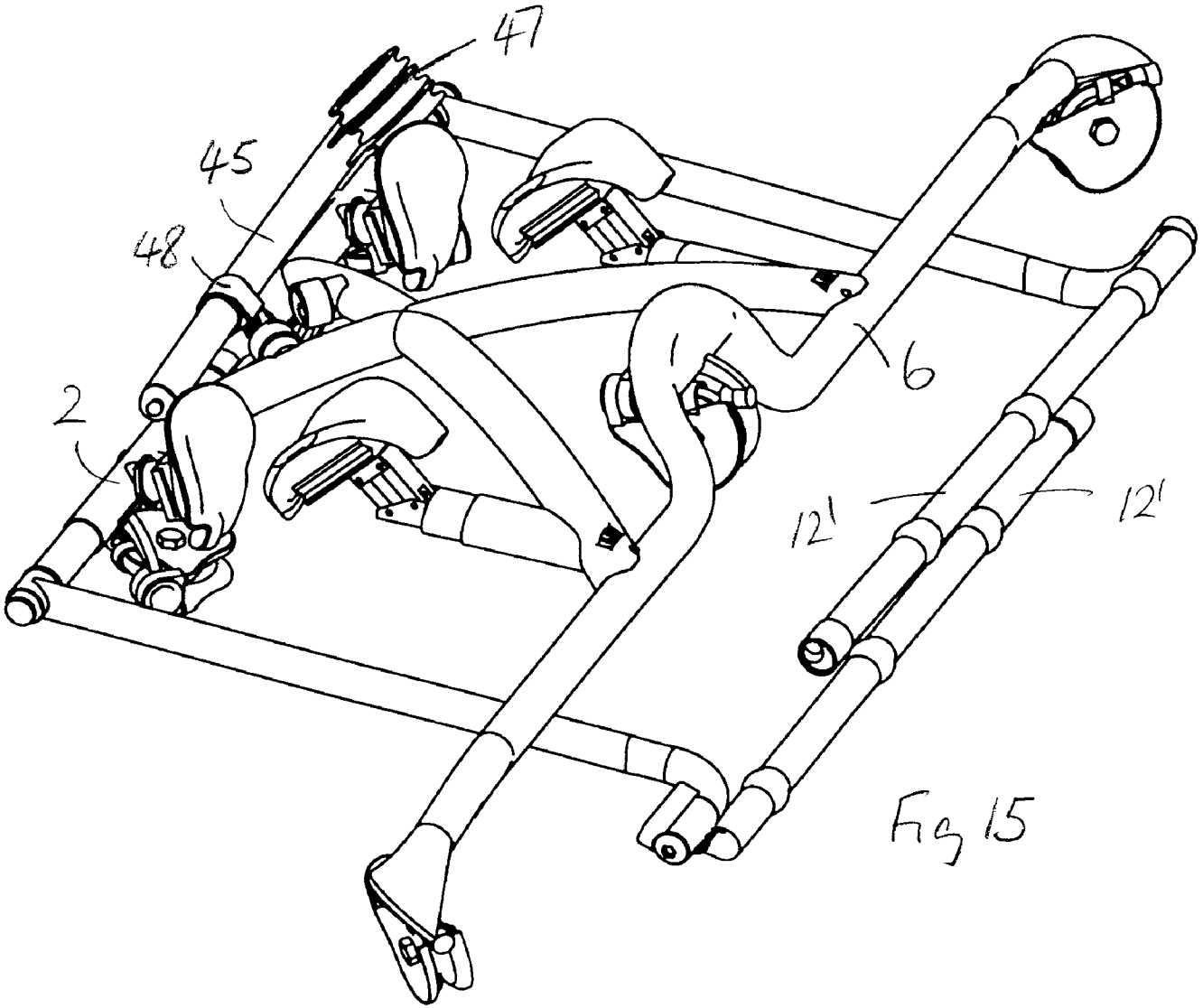
Figure 16:
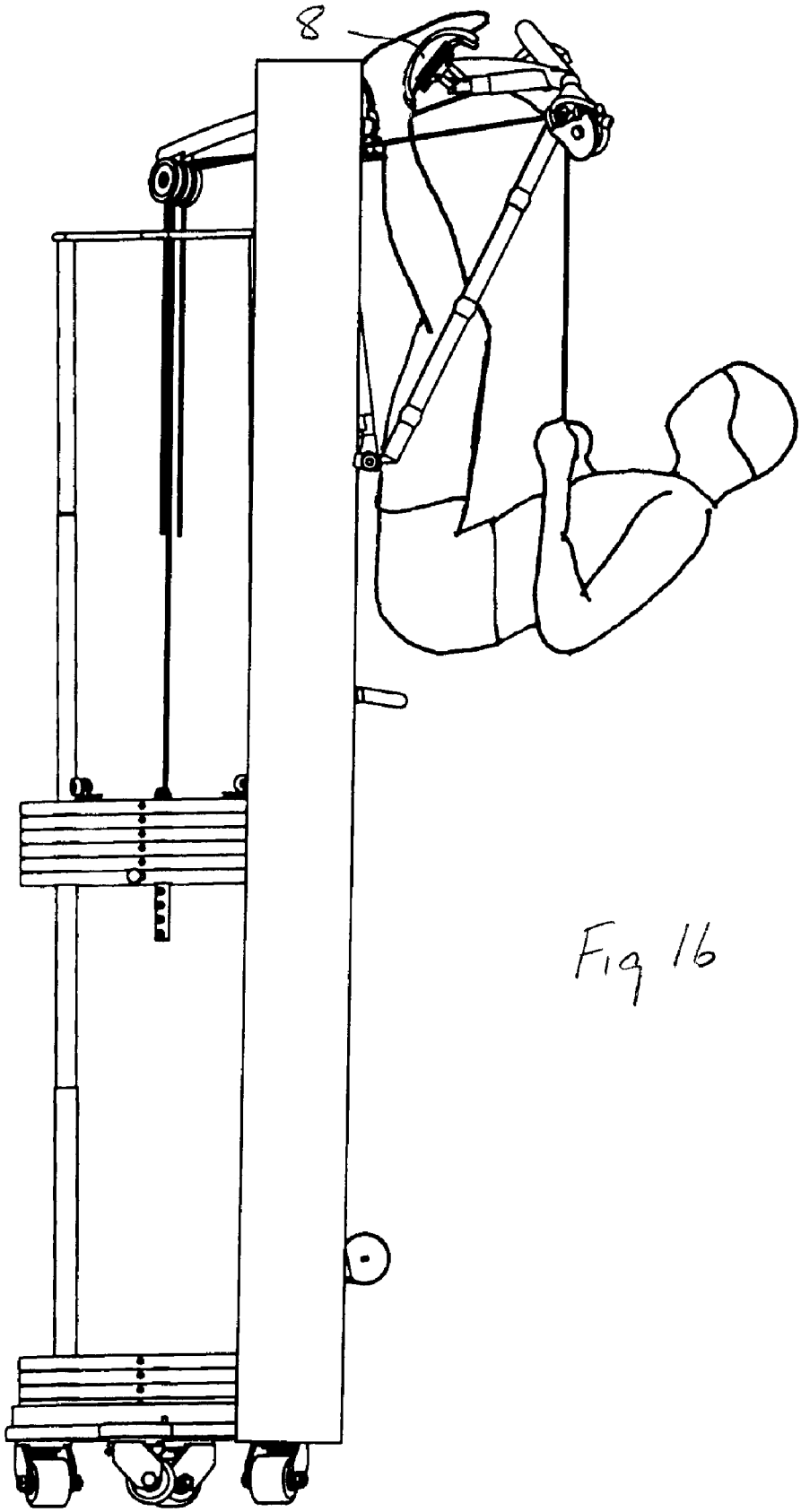

FIGS. 14*a* and 14*b* are front elevational and side isometric views of dip bars;

FIG. 15 is an isometric view of the second embodiment in a fully collapsed condition for storage; and FIG. 16 is an elevational view of a person performing a weight exercise while supported upside down by the footrests.

PARTICULAR DESCRIPTION

Figure 1:
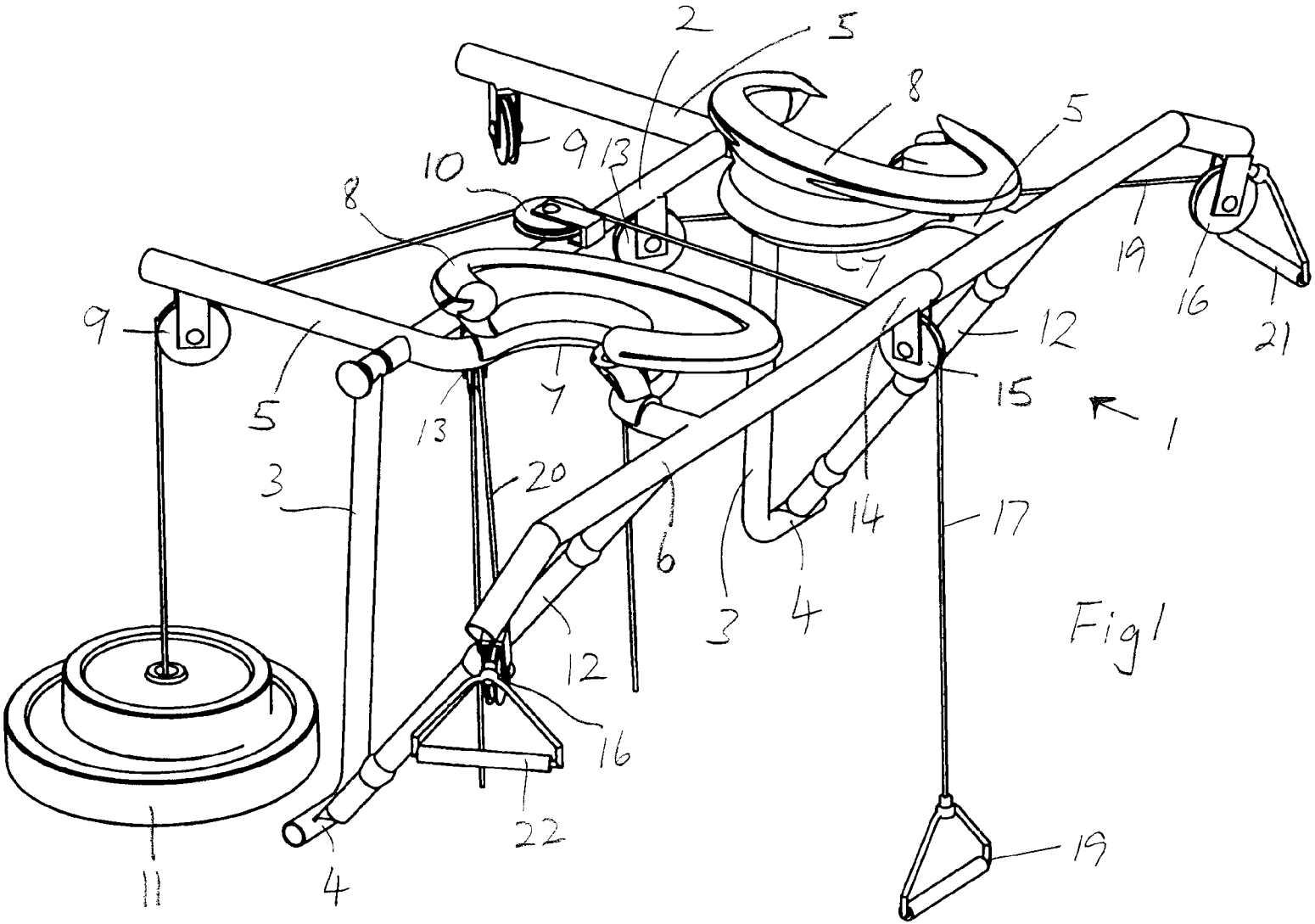
FIG. 1 is an isometric view of a front of an upper frame of a first embodiment of the invention for mounting in a door frame.
Figure 2:
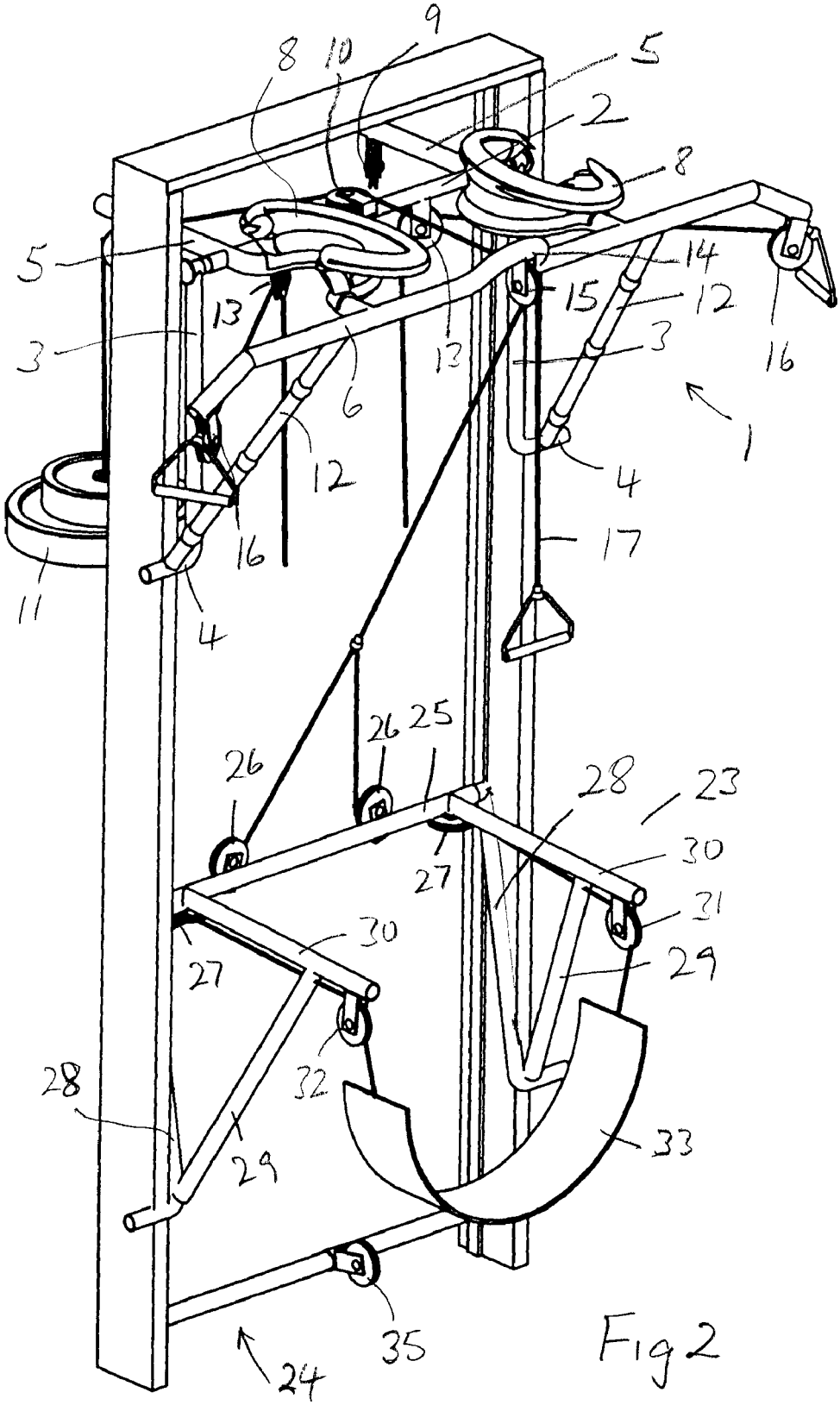
FIG. 2 is an isometric view of the first embodiment of the invention mounted in the door frame.
Figure 3:
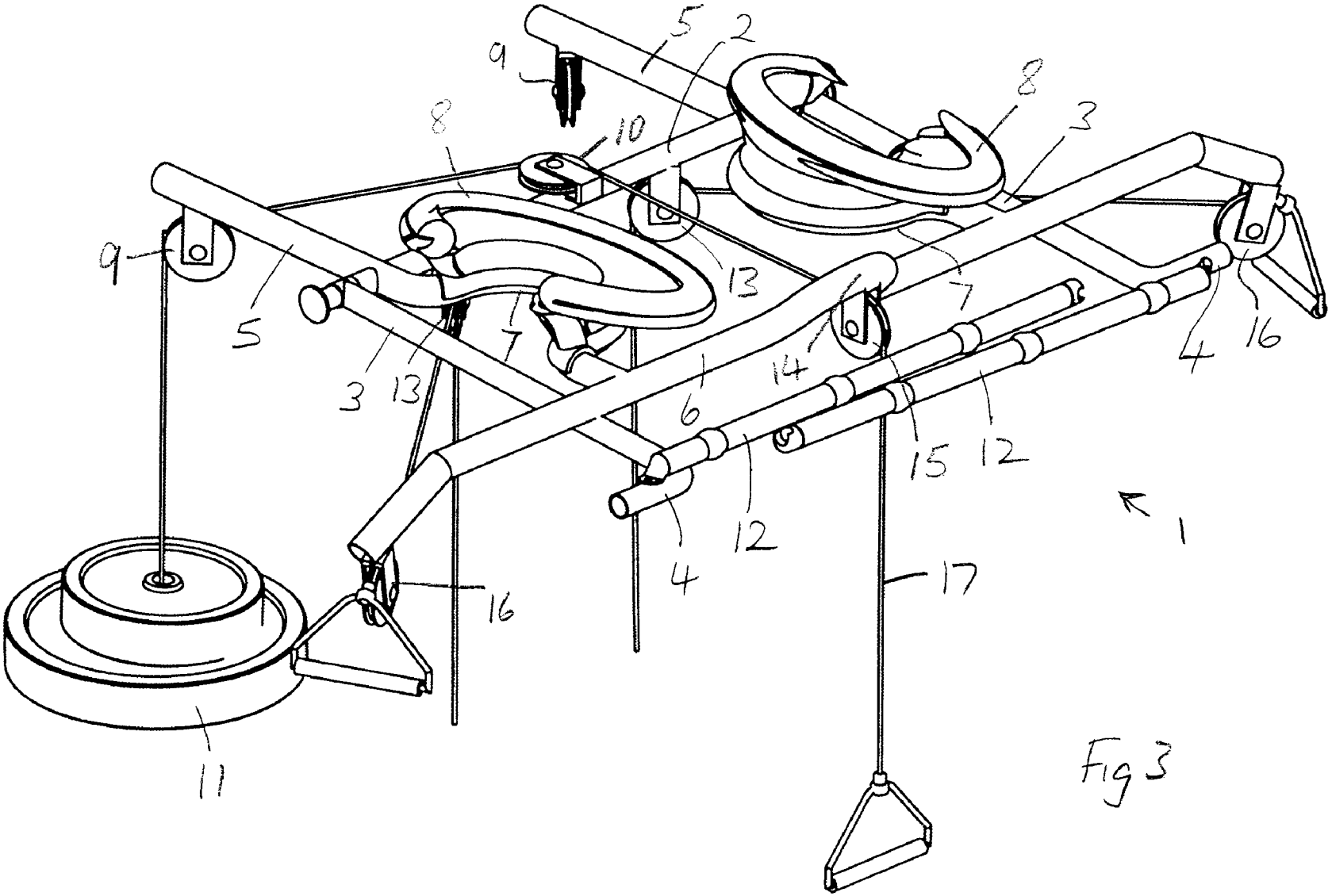
FIG. 3 is an isometric view of the upper frame of the first embodiment in collapsed condition.

As shown in FIG. 1-3, the first embodiment of doorway mounted exercise apparatus includes an upper frame 1 comprising a first, overhead, level/horizontal support bar 2 having respective opposite ends releasably attached to opposite door jams by sliding receipt in upwardly opening slots of brackets (see Fig), screw fitted to respective jambs, so that the support bar bridges the doorway.

A pair of depending stabilizing bars 3 have respective upper ends rotatively connected to the support bar 2 adjacent respective opposite ends thereof and have respective, lower, distal ends 4 bent outwards through a right angle to protrude in front of respective door jambs and carrying respective pressure pads (not shown). Two perpendicular/transverse bars 5 are fixedly connected at intermediate locations to the support bar 2 and at respective forward ends to a second, horizontal pull bar 6 securing it extending in parallel, spaced apart relation in front of the support bar and in front of the doorway. The transverse bars are bent into outwardly open loops 7 between the support and pull bars, which loops support conforming respective foam-padded footrests 8. The transverse bars 5 extend rearwardly of the support bar protruding behind the doorway to hold respective attached pulleys 9 for rotation about horizontal axes when supporting cables of a weight set 11 on either of a selected lateral side of the area behind the doorway.

A pair of depending strut bars 12 have respective upper ends provided with hooked pins received in sockets (not shown) in the pull bar 6 by which they are pivotally and releasably attached to the pull bar 6 adjacent respective opposite ends thereof and the strut bars are pivotally attached at respective lower ends to respective adjacent lower ends 4 of the stabilizing bars 3.

It will be appreciated that, when the frame 1 is mounted in the doorway, as shown in FIG. 2, the outwardly extending lower end portions 4 of the stabilizing bars are brought into stabilizing pressure engagement with a front of each jamb by a person's weight applied to the pull bar 6.

A pulley 10 is mounted on a center of the support bar for rotation about a vertical axis and the support bar carries a pair of pulleys 13 at medial locations between the pulley 10 and opposite support bar ends for rotation about respective horizontal axes The pull bar has a central upbend 14 forming a downwardly opening loop which mounts a pulley 15 for rotation about a horizontal axis and a pair of similarly rotatable pulleys 16 are mounted adjacent respective opposite ends of the pull bar.

Attached to the pulleys 9,10 and 15 is a cable 17 that has a weight set 11 on one end and on the other a handle 19 for a person utilizing the weight. A seat bar may alternatively be provided for a person using the weight set as a counter weight during the performance of a body raising exercise.

Cables 19 and 20 with respective handles 21 and 22 and also pass over respective aligned individual pulleys of the pairs 16 and 13 for optional attachment to the weight set for the performance of other exercises The frame 1 can be collapsed to a compact state by releasing the upper ends of the strut bars 12 from the pull bar 6, swinging strut bars 12 towards each other to extend horizontally in overlapping side by side relation with each other and swinging the stabilizing bars 3 forwards and upwards to extend horizontally with said lower ends 4 adjacent the pull bar 6 so that the overlapping strut bars and the pull bar lie in side by side relation, as shown in FIG. 3.

The collapsed upper can then be removed from the door jambs for storage by raising the opposite ends out of the bracket slots.

Within the level bar 2 is an internal screw adjuster to increase or decrease the length to adjust to door opening of different sizes.

This apparatus permits the body to be increasingly stressed by lessening the weight of the counterweight 18. The stress on the person performing a body raising exercise such as a pull up on the pull bar while also placing weight on the handle 19 (or using the handle as a seat) is the weight of the body less the weight of the counterweight. In addition, adding weights to the harness on the body increases the weight the body must lift, thereby increasing stress on the muscle groups.

As shown in FIG. 2, optional, intermediate bar frame 23 and lower horizontal bar device 24 are provided for releasable securement to opposite sides of the doorjamb with brackets so as to span the doorway.

The intermediate frame 23 has an upper horizontal bar 25 releasably attached to the opposite jambs in the above manner to span the doorway and mounts a pair of pulleys 26 in spaced apart relation for rotation about horizontal axes and another pair 27 for rotation about vertical axes at respective opposite ends. Two depending stabilizing bars 28 and strut bars 29 similar to those described above and two parallel, horizontal, spaced apart, sling bars 30 extend forward from the horizontal bar 25 and carry respective pulleys 31 for rotation about horizontal axes at respective free ends. A sling 33 for supporting a person's knees is suspended between the pulleys by cables extending over the pulleys 31, 27, 26, and pulleys 15, 10 and 9 of the upper frame, to the counterweight 18 to offset a portion of a user's weight, enabling an increased number of push ups and other exercises.

The lower horizontal bar 34 carries a central pulley 35 under which a cable can be connected through a series of pulleys to the weight set to enable a larger number of crunches and other exercises to be performed as well as other simple arm/leg flexing exercises. It may also be used in a weight resist body raising exercise in which the weight set adds weight to the body weight, as described below.

The bars of the device can be fabricated of any suitable material, most commonly one which is substantially inflexible and substantially inelastic, such as steel, aluminum, titanium, carbon fiber in epoxy, fiberglass, or the like.

The straps of the harness can be fabricated of any suitable material, most commonly one that is flexible and substantially inelastic, such as nylon or leather.

Figure 4:
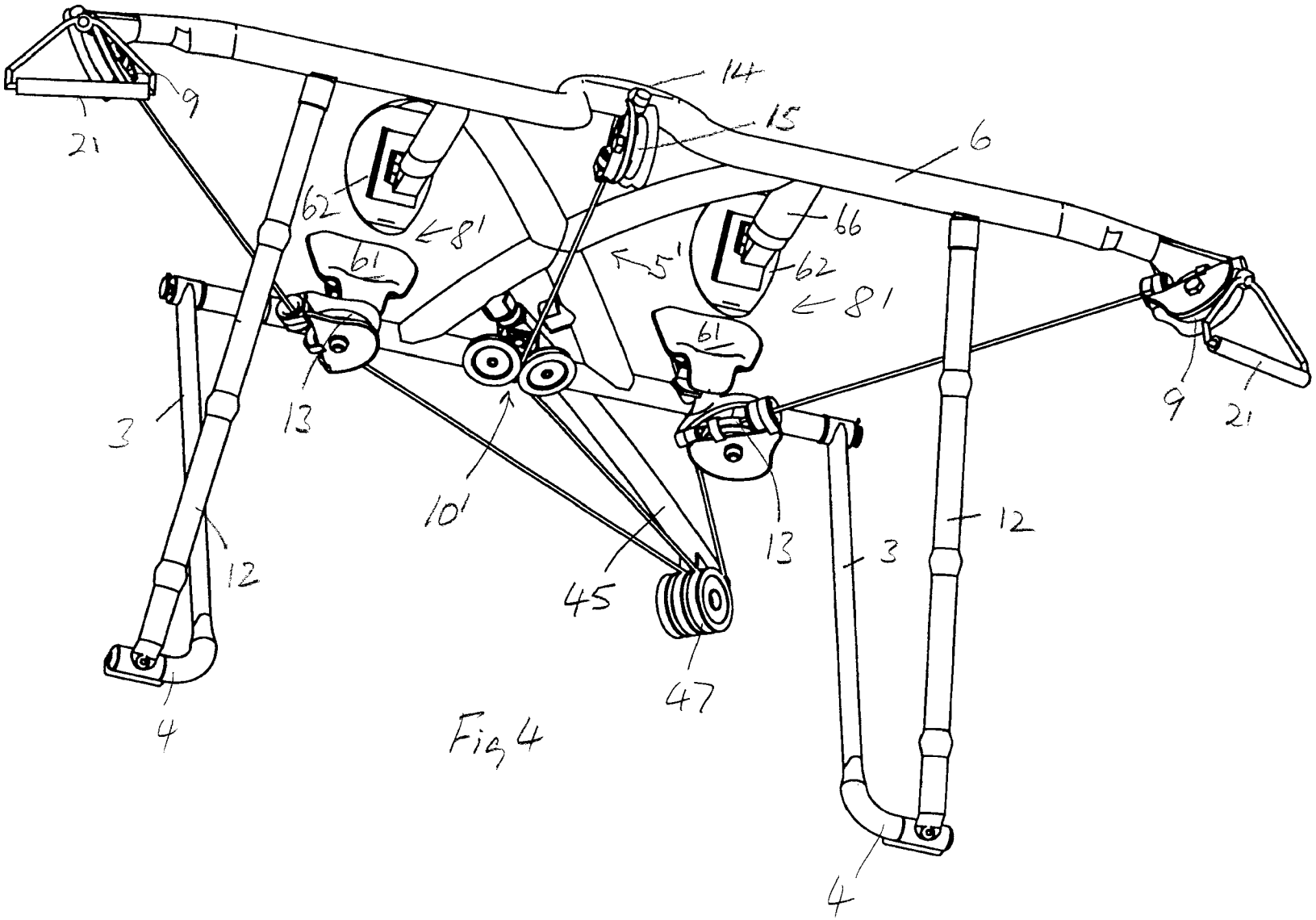
FIG. 4 is an isometrical view from the front and below of the upper frame of the second embodiment.

Briefly stated and as described in more detail below, in the second embodiment, the main structural differences are that, the intermediate frame is replaced by individual depending dip bars 41, (FIGS. 14*a* and 14*b*), the upper frame structure 1' differs in that the previous pair of rearwardly protruding weight set supporting portions are replaced by a single weight set supporting bar 45, (FIG. 4-6) which can be swung between left and right hand lateral sides of the doorway to accommodate both left and right hand opening doors and withdrawn forward within the doorway to permit closure; the foot pads 8' are bipartite; the two transverse bars 5 are replaced by a cruciform transverse bar structure 5'; and single central pulley 10 on the support bar 6 replaced by a pair of pulleys 10' arranged nip fashion, (FIG. 4).

Only the structural differences will therefore be described in detail with like reference numerals used for similar elements and primed reference numerals for modified elements.

Figure 5:
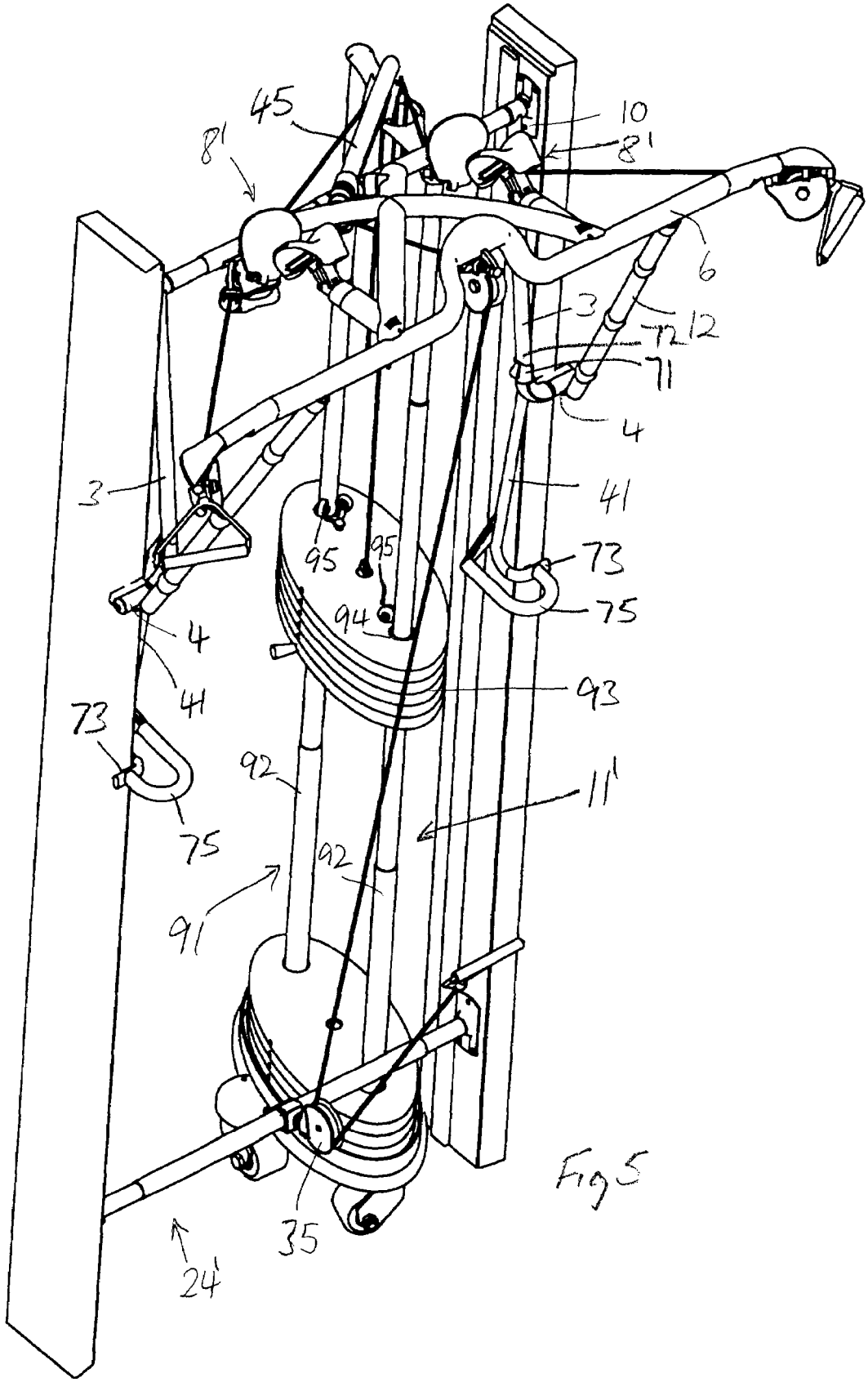
FIG. 5 is an isometric view of the second embodiment mounted in a doorway with the lintel omitted for clarity.
Figure 6:
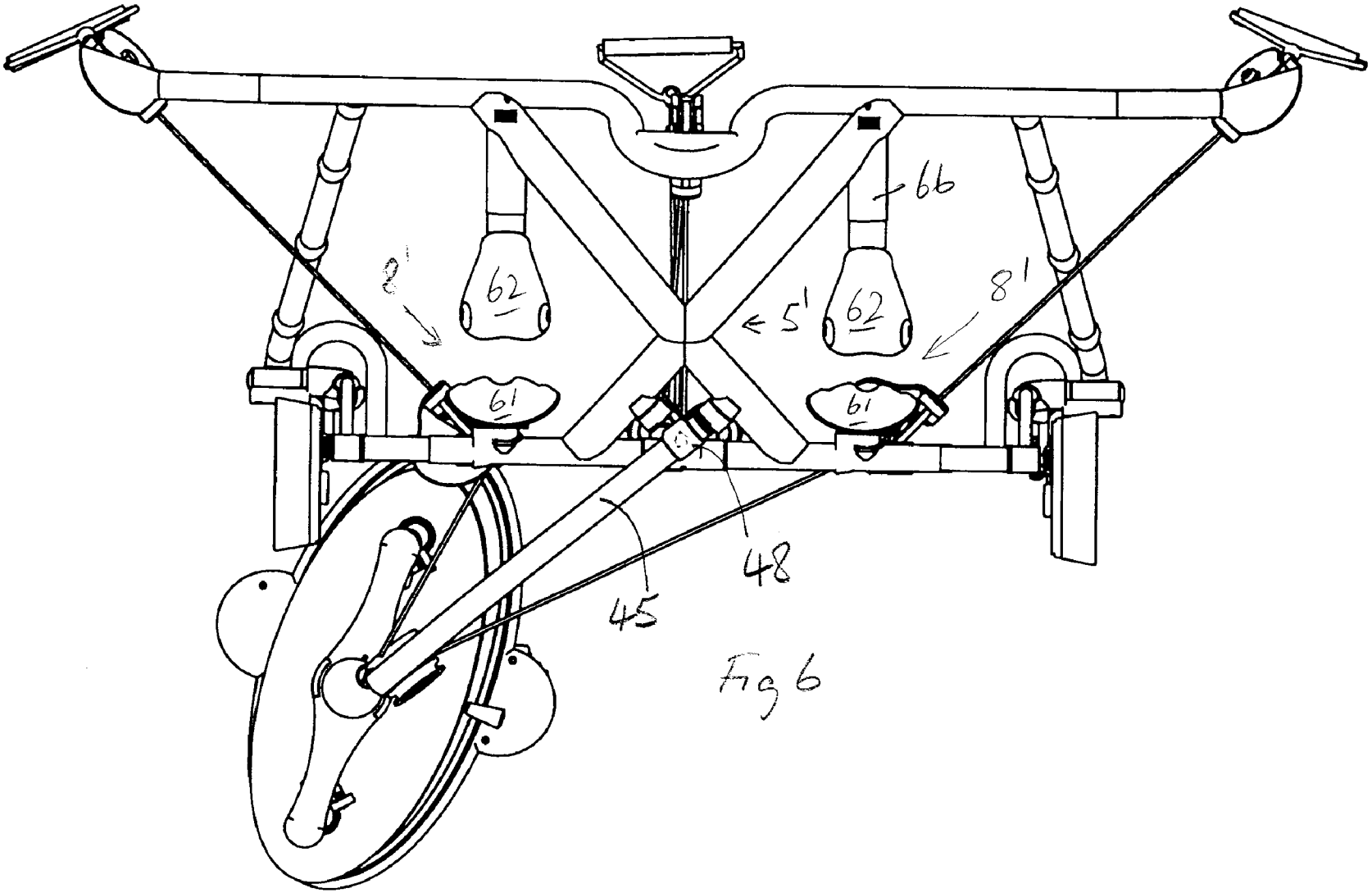
FIG. 6 is a top plan view of the second embodiment mounted in a doorway with the lintel omitted for clarity.
Figure 7:
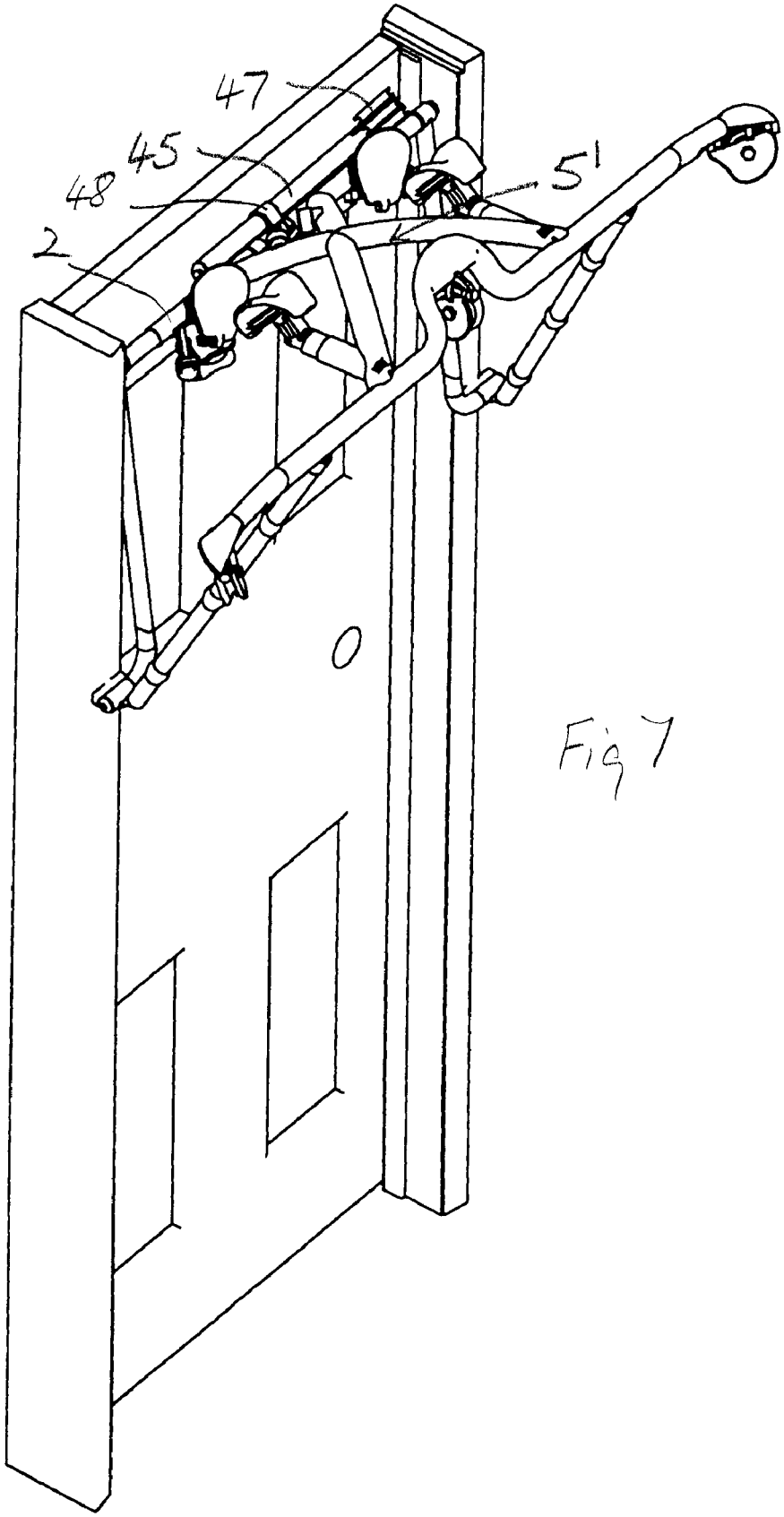
FIG. 7 is an isometric view of the top and front of the upper frame of the second embodiment mounted in a doorway with the door closed.

As shown in FIG. 4-6, the weight set supporting bar 45 carries a dual weight set cable pulley 47 at a distal rear end and has a forward end slidingly received in a sleeve 48 pivotally mounted on another sleeve receiving the horizontal support bar 2 for the lateral swinging movement and for forward axial sliding movement therein between the extended, operating position shown in FIGS. 4 and 6 and the withdrawn, inoperative position in which the weight set supporting bar extends in overlying side by side relation with the support bar 2 as shown in FIG. 7.

Figure 8:
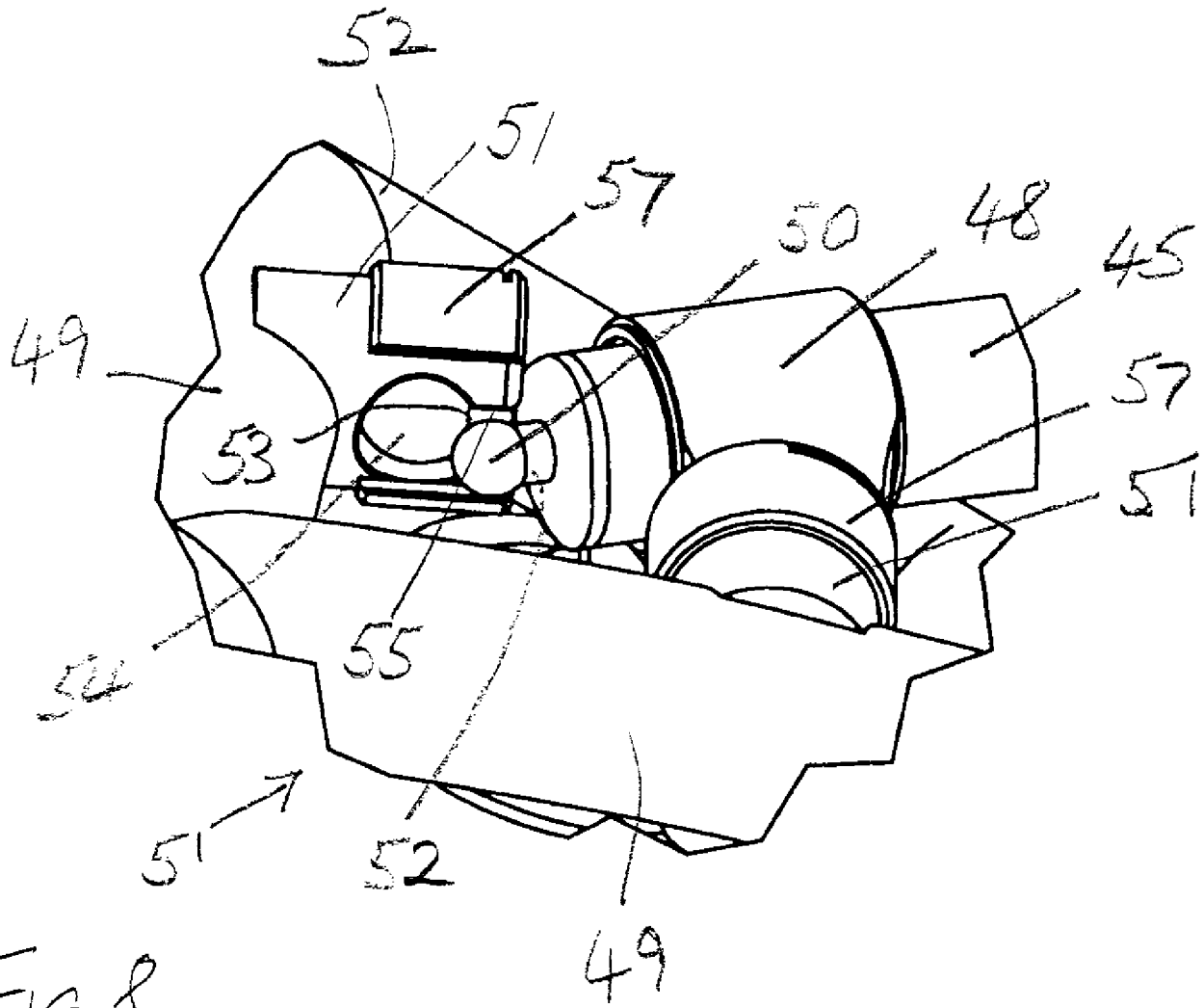
FIG. 8 is a fragmentary isometric view of the locking mechanism for the weight set supporting bar.

The support bar 2 and pull bar 6 are rigidly connected by a cruciform transverse bar structure 5' and, as shown in detail in FIG. 8, sockets 51 are mounted on adjacent rear portions 49 of the transverse bars so as to extend obliquely therefrom and open rearwardly towards respective lateral opposite sides of the doorway. The forward mating end of the weight set support bar 45 has an axially protruding ball head 50 supported by a neck 52 and each socket mouth has an inwardly extending annular retention lip 53, a lateral access aperture 54 with a narrow mouth 55 sized to permit the head 50 and neck 52 o pass laterally therethrough into the socket by pivotal movement of the bar. An axially slit, flanged collar 57 is mounted for rotation on each mouth so that when the collar 57 is turned manually to align the slit 58 with the access aperture 54, the head 50 and neck 51 can pass laterally therethrough into the socket by pivotal movement of the bar. Manual rotation of the locking collar 57 closes the access aperture 54 trapping the head and neck in the socket engaged behind the retention lip 53 and thereby locking the weight support bar extending on the corresponding lateral side behind the doorway. Rotation of the locking collar 57 to bring the slit back into registration with the lateral opening permits the head and neck to be pivoted through the lateral opening out of the socket and the weight set support bar 45 to be swung to the other side and locked in the other socket for supporting a weight set on the other lateral side of the door, or swivelled by sliding forward in the sleeve and swinging forward to overlie the support bar 2 in the collapsed inoperative condition, shown in FIG. 7.

Figure 9:
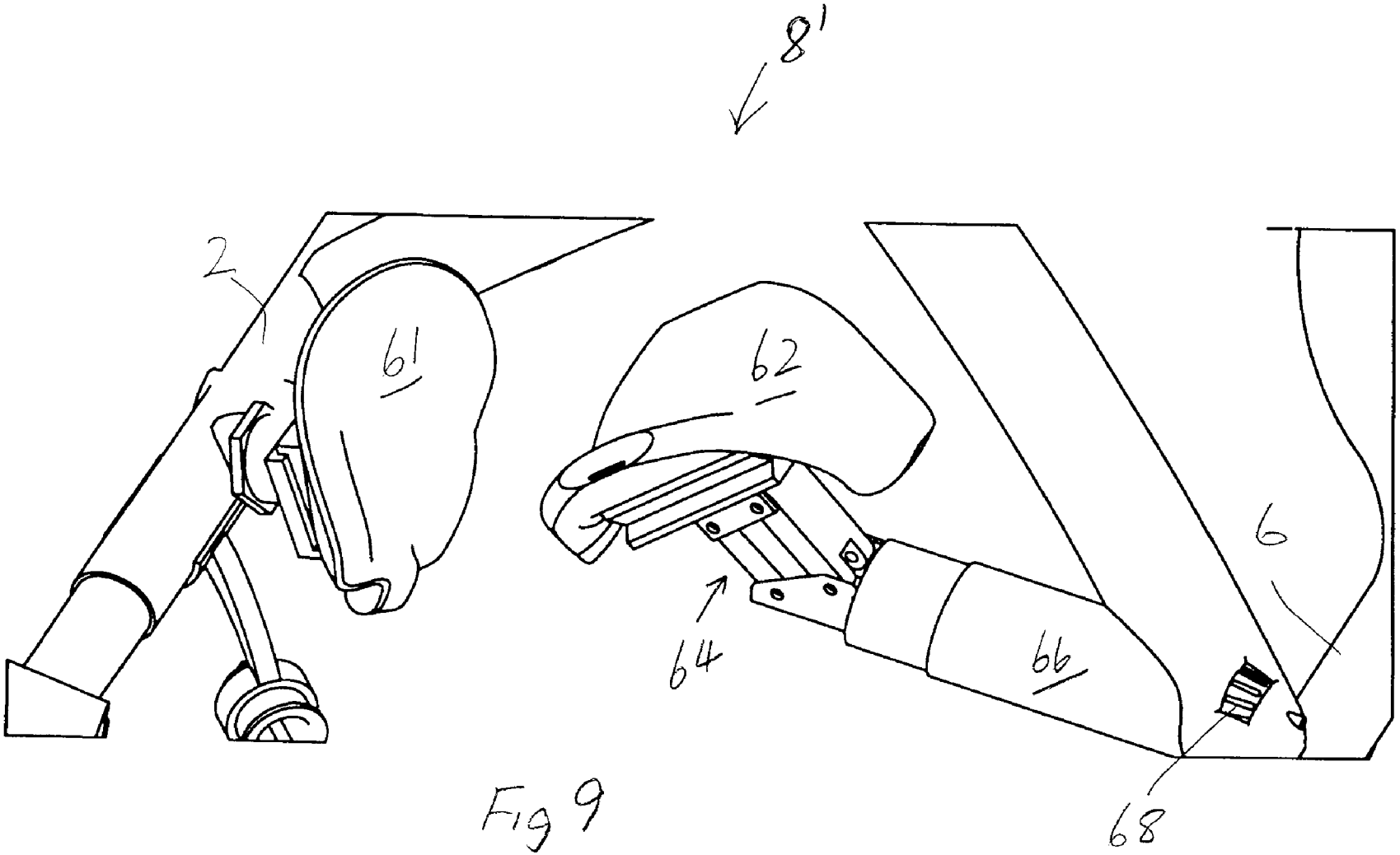
FIG. 9 is a fragmentary isometric view of a bipartite footrest.

The foot rests 8' each comprise a discrete heel engaging portion 61 and a discrete instep engaging portion 62 which portions are supported by the frame in adjacent spaced apart relation from each other. As shown in FIG. 9, each instep engaging portion 61 is mounted for limited rocking movement on pivoted links 64 supported by the end of a stub shaft 66 which is fixed to the pull bar 6. A adjustment screw mechanism operable by finger wheel 68 is provided within the stub shaft to vary the separation of the instep engaging portion from the heel engaging portion to adjust to feet of different sizes.

As shown in FIGS. 5, 14*a* and 14*b*, the dip bars 41 have respective upper ends formed with tapered hooking elements 71 which attach by downward application to waisted portions 72 of the stabilizing bars formed adjacent respective lower ends so that the dip bars depend therefrom within the doorway adjacent respective door jambs. The dip bars are bent outward at respective, padded lower ends 73 for engagement with the front of the jamb and looped handrests 75 are provided thereon to protrude forward out of the doorway. It will be appreciated that the outwardly bent lower ends 73 will be pivotally biased into stabilizing pressure engagement with a front of each jamb by weight applied to the hand rests by a person performing dips.

Figure 10:
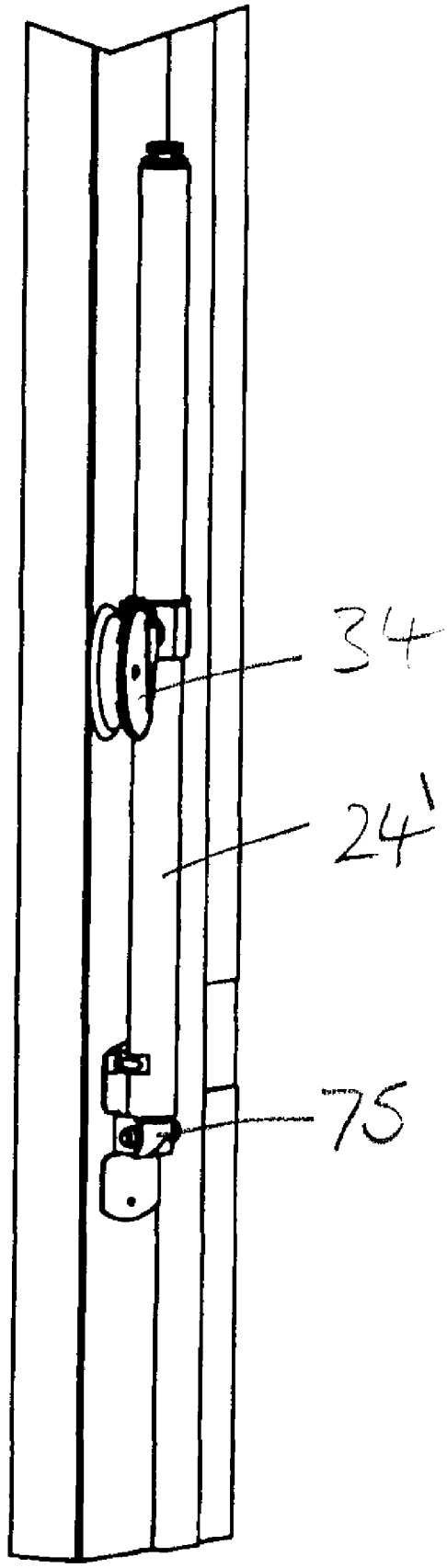
FIG. 10 is a fragmentary view of a lower horizontal bar device folded in a retracted position.

As shown in FIG. 10, the lower horizontal support bar 24' is attached by a hinge 75 to one jamb and has the opposite end releasably mounted in a bracket secured to the other jamb enabling the bar 24' to be swung upward to lie against the one jamb when not in use so as not to obstruct the doorway.

Figure 11:
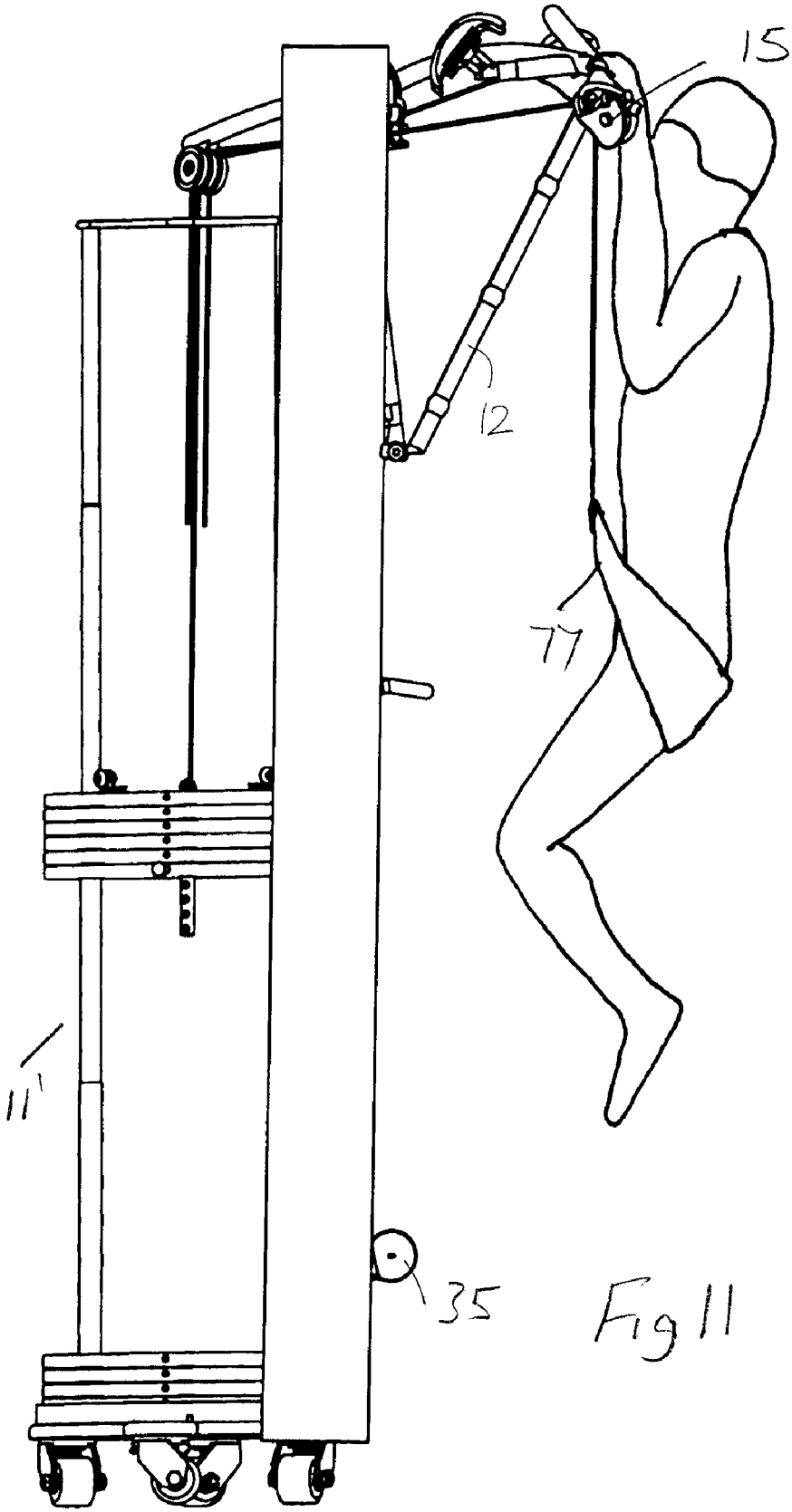
FIG. 11 is a schematic side elevation of the second embodiment used for weight assistance during pull ups.

FIG. 11 illustrates the use of the weight set as a counterweight to assist upward body movement when a person performs pull ups on the pull bar 6 by passing the weight set connected cable first upwards over the pulley 15 whereby the cable applies an upward tension to a body harness 77 reducing the effective body weight.

Figure 12:
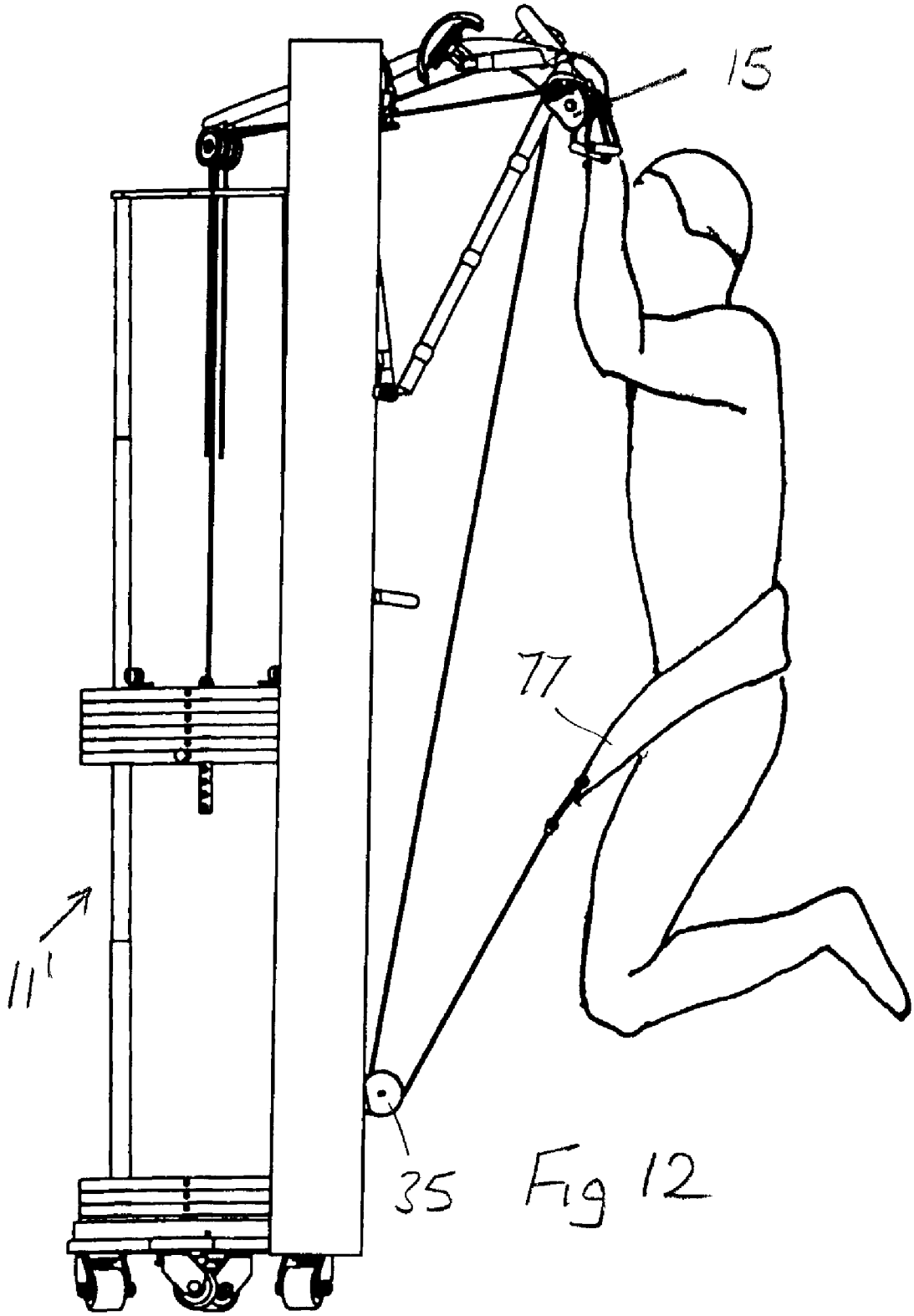
FIG. 12 is a schematic side elevation of the second embodiment used for weight resistance during pull ups.

FIG. 12 illustrates the use of the weight set to provide additional resistance to body weight by passing a weight set connected cable first under the lower pulley 35 to provide a downward tension on the cable linked to the body harness 77 and then over the top pulley 15, increasing the effective body weight, both body weight assist and resist being enabled by the same apparatus.

Figure 13:
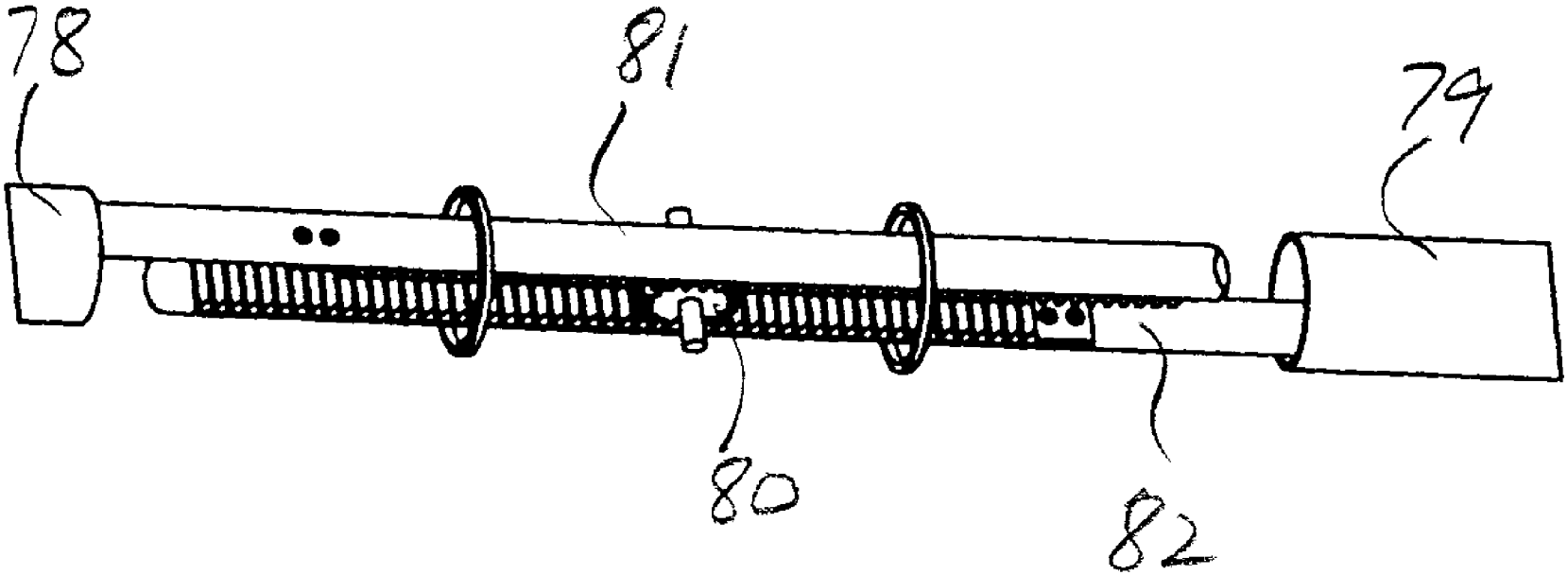
FIG. 13 is a fragmentary diagrammatic view of a support bar length adjustment mechanism.

As shown in FIG. 6 and FIG. 13, the support bar 2 is constructed from telescoping sections 78 and 79 and a pinion gear 80 is meshed between racks 81 and 82 attached to respective sections to permit the bar length to be extended and contracted evenly to adjust to doorways of differing widths simply by a person pulling the stabilizing bars apart and pushing them together. At the same time, the strut bars may also be angularly spread apart or together by pivoting on the pull bar 6 to ensure that their outbent ends are aligned for pressure engagement with the jambs.

As shown in FIG. 5, the weight set 11' comprises a frame 91 with telescopic vertical shafts 92 on which weights 93 formed with shaft receiving apertures 94 permitting upward travel and rollers 95 are spring biased to press against the shafts to maintain the weights centrally and stably mounted in spite of the changing diameters of different shaft sections.

The term 'jamb' as used herein means the inside surface of the door post.

The invention claimed is:

1. A body exercise apparatus mounted in a doorway independently of any door comprising:

a frame comprising a first, overhead, level/horizontal support bar having respective opposite ends attached to inner facing surfaces of upper ends of the door jambs so as to bridge the doorway; a second, overhead horizontal, pull bar attached by at least one transverse bar to the support bar to extend in parallel spaced apart relation in front of the support bar and in front of the doorway; a pair of depending stabilizing bars having respective upper ends attached to the support bar adjacent opposite ends thereof and, a pair of depending strut bars attached at upper ends to the pull bar adjacent respective opposite ends thereof and at respective lower ends to respective adjacent lower ends of the stabilizing bars; an outwardly extending potion provided on each lower end of one of the stabilizing bar and strut bar to protrude in front of respective door jambs so as to be brought into stabilizing pressure engagement therewith by a person's weight applied to the pull bar whereby the frame is mounted in the doorway independently of any door being supported soley by the door jambs;

the frame further comprising means for operatively supporting a resistance set, which means comprises a resistance set supporting bar which, in an operating position, protrudes horizontally rearwards, cantilever fashion, out of a top of the doorway and has a resistance set cable pulley mounted on a distal, rear end, wherein means are provide on the frame for pivotally mounting the resistance set supporting bar for horizontal swinging movement about a vertical axis between either lateral side of the doorway adjacent respective door jambs, as selected, thereby to accommodate both left hand and right hand, rearwardly opening doors.

2. A body exercise apparatus according to claim 1 wherein the frame comprises means for locking, releasably, the resistance set supporting bar in either lateral position.

3. A body exercise apparatus according to claim 2 wherein the means for pivotally mounting the resistance set supporting bar for horizontal swinging movement between either lateral side of the doorway enables swinging movement of the resistance set supporting bar between the rearwardly protruding, extended operating position and an inoperative, collapsed position, withdrawn forwards so as not to protrude behind the door frame and to enable a rearwardly opening door to be closed completely with the apparatus remaining mounted on respective door jambs.

4. A body exercise apparatus according to claim 3 wherein the means for pivotally mounting the resistance set comprises a sleeve pivotally mounted on the horizontal support bar and slidingly receiving the resistance set supporting bar for axial movement in the sleeve between the extended and the withdrawn positions.

5. A body exercise apparatus according to claim 4 wherein the sleeve is pivotally mounted on the horizontal support bar so that the resistance set supporting bar extend side by side in the withdrawn position.

6. A body exercise apparatus according to claim 1 wherein overhead foot rests are attached to the frame at spaced apart overhead locations between the support bar and the pull bar and are each shaped to supportively engage an inverted heel and an inverted instep so that a person exercising can hang upside down therefrom by their feet.

7. A body exercise apparatus according to claim 6 wherein the foot rests each comprise a discrete inverted heel engaging portion and a discrete inverted instep engaging portion which portions are supported by the frame in adjacent spaced apart relation from each other providing respective ankle entry apertures.

8. A body exercise apparatus according to claim 7 wherein the instep engaging portion is pivotally mounted for limited swivelling movement and screw means are provided to vary the relative separation of the heel engaging portion and the instep engaging portion to adjust to feet of different sizes.

9. A body exercise apparatus according to claim 1 wherein the upper ends of respective stabilizing bars are pivotally attached to the level support bar for swinging movement about the support bar in respective vertical planes; the strut bars are attached releasably to the pull bar at respective upper ends and pivotally attached at respective lower ends to the corresponding lower ends of respective stabilizing bars for swinging movement transversely thereof, so that the apparatus can be collapsed to a compact state by releasing the upper ends of the strut bars from the pull bar, swinging the support bars forwards and upwards to extend horizontally with said lower ends adjacent the pull bar and swinging strut bars towards each other to extend horizontally in side by side relation with each other and with the support bar.

10. A body exercise apparatus according to claim 9 further comprising means for operatively supporting a resistance set comprising resistance set supporting bar movable between an operative position in which the resistance set supporting bar protrudes behind the doorway and an inoperative, collapsed position, in which the resistance set supporting bar is withdrawn forwards so as not to protrude behind the doorway so as to enable a rearwardly opening door to be closed completely.

11. A body exercise apparatus according to claim 10 wherein respective opposite ends of the horizontal support bar are attached releasably to the respective door jambs.

12. A body exercise apparatus according to claim 1 and for providing, selectively, assistance and resistance to a person exercising comprising;

means for attaching a cable to an attachment point of a person's body;

a lower horizontal support bar attached at respective opposite ends to respective door jambs at a lower height adjacent a standing exerciser' feet so as to bridge the doorway;

pulley means mounted on one of said at least one upper horizontal support bars and pulley means mounted on said lower horizontal support bar;

so that a cable attached at one end to the resistance set and at an opposite end to the body attachment point can selectively be passed over one of the upper pulley means and over the lower pulley means to extend upwardly from the body attachment point and downwardly from the body attachment point, respectively, to provide an upward assisting force and a downward resisting force, respectively, for a person performing a body lifting exercise wherein:

the lower horizontal bar is hingedly attached at one end to the jamb and releasably attached at the opposite end to the jamb so that it can be swung upwards laterally out of the path of the doorway to extend vertically adjacent the jamb leaving the doorway free for access therethrough.

13. A body exercise apparatus according to claim 1 wherein foot rests are attached to the frame at spaced apart locations between the support bar and the pull bar and are each shaped to supportively engage an inverted heel and an inverted instep so that a person exercising can hang upside down therefrom by their feet while raising their body with assistance from the resistance set.

14. A body exercise apparatus according to claim 6 wherein said at least one transverse bar comprises two transverse bars and the foot rests comprise laterally open, horizontal loops in respective transverse bars, respective loop openings providing ankle entry apertures.

15. A body exercise apparatus according to claim 2 wherein the means for locking, releasably, the resistance set supporting bar comprises one of plug and socket means mounted on respective transverse bars and aligned obliquely of each other rearwardly towards respective opposite sides of the doorway for selective mating with a proximal end of the resistance set supporting bar when in an extended position.

16. A body exercise apparatus according to claim 1 wherein the means for operatively supporting a resistance set comprises a sleeve which receives the resistance set supporting bar for sliding movement between the rearwardly protruding operating position and an inoperative, collapsed position, in which the resistance set supporting bar is withdrawn forwards so as not to protrude behind the door frame so as to enable a rearwardly opening door to be closed completely.

17. A body exercise apparatus according to claim 1;

wherein a first pair of pulleys is mounted for rotation in a horizontal plane on the horizontal support bar, aligned under the proximal end of the resistance set supporting bar when extended in operating position; pulleys of a second pair of pulleys are mounted for rotation in respective vertical planes and for pivotal movement in a horizontal plane in spaced apart relation on the horizontal support bar at medial locations between respective pulleys of the second pair and respective opposite ends of the support bar; respective pulleys of a third pair of pulleys are mounted for rotation in vertical planes at respective opposite ends of the pull bar and a pulley is mounted for rotation in a vertical plane in downwardly open loop bent in the center of the pull bar, whereby a cable extending upward from the weight set, over the pulley on the distal rear end of the resistance set supporting bar can selectively be passed over either pulley of the first pair and an adjacent pulley of the second pair to an adjacent pulley of the third pair or between both pulleys of the first pair over the pulley on the center of the pull bar to enable the performance of different body exercises.

18. A body exercise apparatus mounted in a doorway independently of any door, comprising:

a frame comprising a first, overhead, horizontal support bar having respective opposite ends attached to inner, facing surfaces of upper ends of the door jams so as to bridge the doorway; a second, overhead, horizontal, pull bar attached by at least one transverse bar to the support bar to extend in parallel spaced apart relation in front of the support bar and in front of the doorway; a pair of depending stabilizing bars having respective upper ends attached to the support bar adjacent opposite ends thereof and, a pair of depending strut bars attached at upper ends to the pull bar adjacent respective opposite ends thereof and at respective lower ends to respective adjacent lower ends of the stabilizing bars; an outwardly extending portion provided on each lower end of one of the stabilizing bar and strut bar to protrude in front of respective door jambs so as to be brought into stabilizing pressure engagement therewith by a person's weight applied to the pull bar whereby the frame is mounted in the doorway independently of any door being supported entirely by the door jambs;

wherein the apparatus further comprises unitary, loose piece, dip bars having respective upper ends and lower ends joined together by respective elongate intermediate portions, the upper ends being formed with hooking elements attached releasably, as loose pieces, by hooking application to respective portions of respective stabilizing bars adjacent respective lower ends of the stabilizing portions, so that respective elongate intermediate portions depend therefrom extending downwards within the doorway adjacent and alongside respective door jambs so that the dip bars are suspended by the frame spaced above a floor surface, said lower ends being formed with respective loops having handrest forming portions that curl inwardly, forwards and then outwards, protruding out of a front of the doorway, shaft portions extending laterally outwardly from free ends of the respective loops to protrude in front of respective door jambs so as to be pivotally biased into stabilizing pressure engagement with a front of each jamb by weight applied to the hand rests by a person performing dips.

19. A body exercise apparatus according to claim 18 wherein the stabilizing bars are formed with respective waisted portions adjacent their respective lower ends which embrace respective waisted portions of the stabilizing bars to releasably attach respective dip bars to respective stabilizing bars.

20. A body exercise apparatus according to claim 18 wherein foot rests are attached to the frame at spaced apart locations between the support bar and the pull bar and are each shaped to supportively engage an inverted heel and an inverted instep so that a person exercising can hang upside down therefrom by their feet.

* * * * *